United States Patent [19]

Minton

[11] 4,085,598

[45] Apr. 25, 1978

[54] RING SAW FOR CIRCULAR KNITTING MACHINE

[76] Inventor: Clarence W. Minton, 4802 Dakota Ave., Nashville, Tenn. 37209

[21] Appl. No.: 754,173

[22] Filed: Dec. 27, 1976

[51] Int. Cl.[2] ..... D04B 15/61

[52] U.S. Cl. ..... 66/145 R

[58] Field of Search ..... 66/134, 140 R, 140 S, 66/145 R, 145 S

[56] References Cited

U.S. PATENT DOCUMENTS

| | | | |
|---|---|---|---|
| 3,225,571 | 12/1965 | Mahler | 66/140 R |
| 3,283,544 | 11/1966 | Kent | 66/140 R |
| 3,345,834 | 10/1967 | Parthum | 66/140 S X |
| 3,668,899 | 6/1972 | Grewcock et al. | 66/140 S |
| 3,714,799 | 2/1973 | Minton | 66/140 S |

FOREIGN PATENT DOCUMENTS

| | | | |
|---|---|---|---|
| 1,303,366 | 7/1962 | France | 66/145 S |
| 1,139,539 | 1/1969 | United Kingdom | 66/140 S |

*Primary Examiner*—Wm. Carter Reynolds
*Attorney, Agent, or Firm*—Harrington A. Lackey

[57] ABSTRACT

A ring saw apparatus adapted to be supported between the welting dial and the dial pad of a circular knitting machine, including a discrete ring or annular saw blade having substantially flat or planar opposed surfaces and an annular ring carrier adapted to be detachably secured to the saw blade and rotatably mounted upon the annular bearing surface of the dial pad. The carrier and saw blade are readily disengaged to facilitate sharpening the saw blade.

1 Claim, 6 Drawing Figures

RING SAW FOR CIRCULAR KNITTING MACHINE

BACKGROUND OF THE INVENTION

This invention relates to a circular knitting machine, and more particularly to a ring saw apparatus for a circular knitting machine.

In a conventional circular knitting machine, the threads fed to the needles are engaged and carried by the teeth of a saw blade rotatably to a knife fixed upon the dial pad for cutting the threads. The conventional saw blade in a circular knitting machine is provided with an upward projecting, circular or cylindrical inner flange surrounding a recessed seat adapted to rotatably engage the annular bearing on the dial pad.

When the teeth of a conventional saw blade become dull, the saw blade is removed for sharpening. However, it is difficult to sharpen the teeth of the saw blade because of the projecting annular inner flange. The sharpening of such saw teeth is laborious and time-consuming.

Furthermore, the manufacture of such conventional saw blades is difficult because of the inner flange projecting from the upper face of the saw blade.

SUMMARY OF THE INVENTION

It is therefore an object of this invention to provide in a circular knitting machine a ring saw apparatus made of two discrete elements adapted to be quickly, easily and detachably connected together for rotation.

The ring saw apparatus made in accordance with this invention includes a ring saw blade, having substantially flat or parallel, continuous, planar, opposed surfaces, and a ring carrier having an outer cylindrical rim or flange and an inner recessed bearing surface for rotatably engaging the annular bearing surface of the dial pad.

Furthermore, the discrete ring carrier is provided with means for detachably engaging the saw blade so that the carrier and saw blade will be firmly secured together for rotary movement, yet may be quickly and easily detached and dis-assembled to facilitate sharpening the saw blade.

The separate discrete carrier and saw blade elements also are more easily manufactured than a unitary ring saw apparatus including the inner upstanding annular flange and inner bearing surface.

The preferred means for detachably engaging the carrier with the saw blade is a pair of dogs depending from the lower surface of the carrier to engage cooperating slots within the inner portion of the saw blade.

DESCRIPTION OF THE PREFERRED EMBODIMENTS

Figure 6:
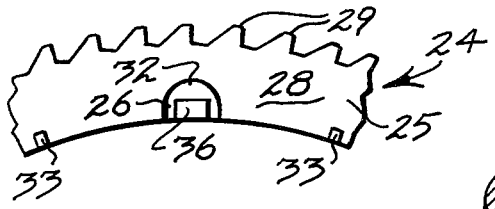
FIG. 6 is an enlarged, fragmentary, bottom plan view of the assembled ring saw appratus.
Figure 3:
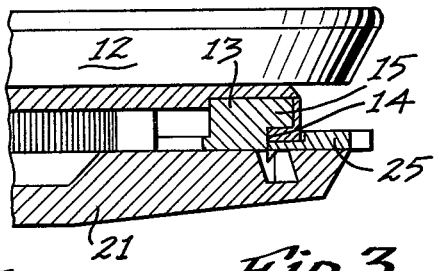
FIG. 3 is an enlarged, fragmentary section taken along the line 3—3 of FIG. 1.
Figure 1:
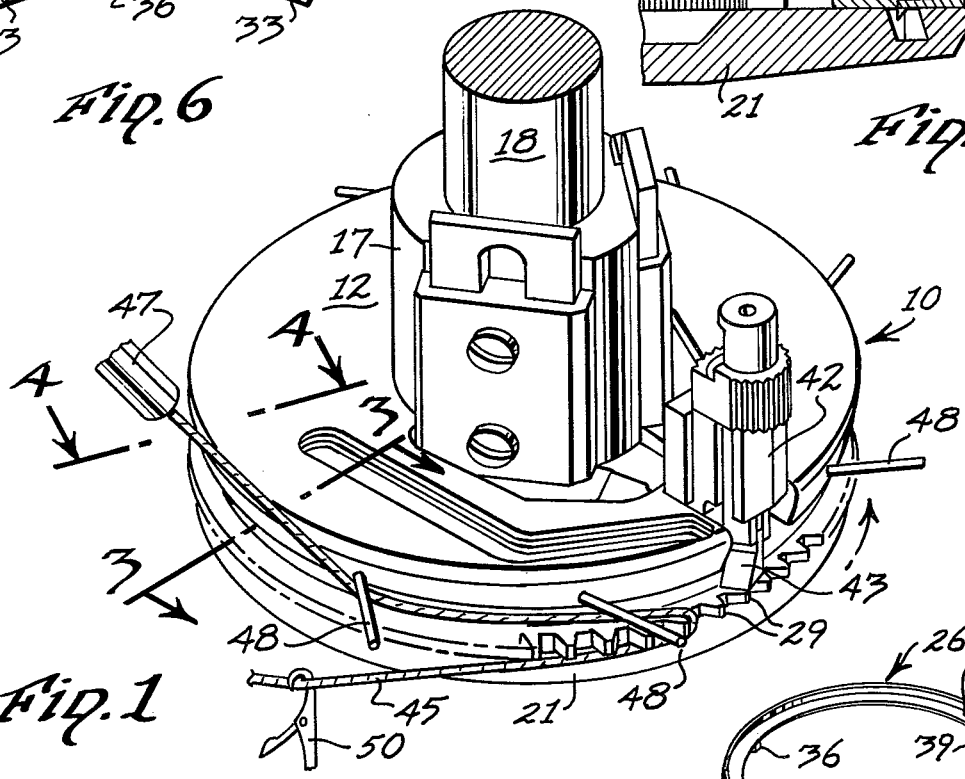
FIG. 1 is a fragmentary, top perspective view of the trimmer apparatus above the knitting head of a circular knitting machine.

Referring now to the drawings in more detail, FIG. 1 discloses a thread cutting or trimming apparatus 10 normally located at the upper end of a knitting head for a circular knitting machine.

Figure 2:
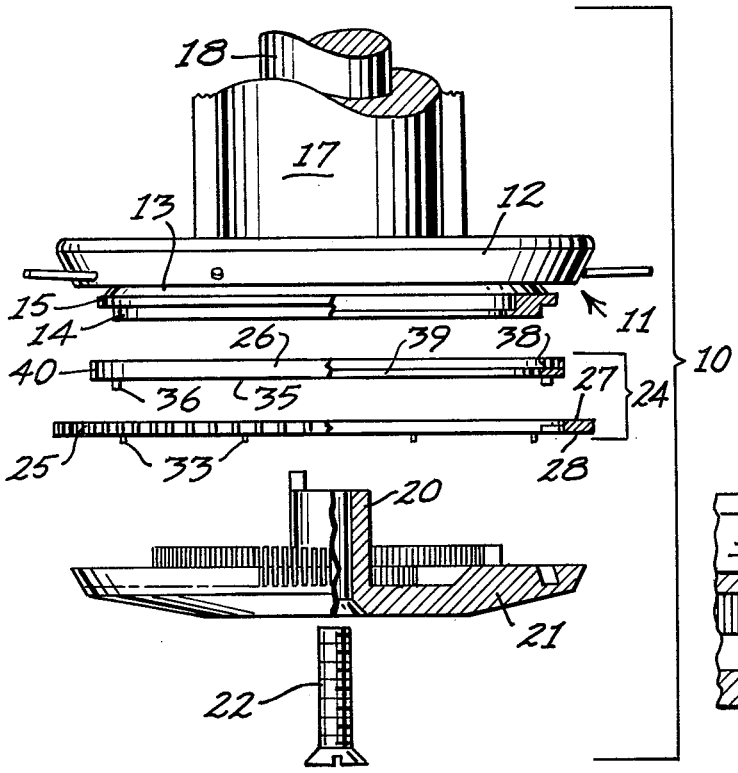
FIG. 2 is a front, exploded, elevational view of the trimmer apparatus disclosed in FIG. 1.
Figure 5:
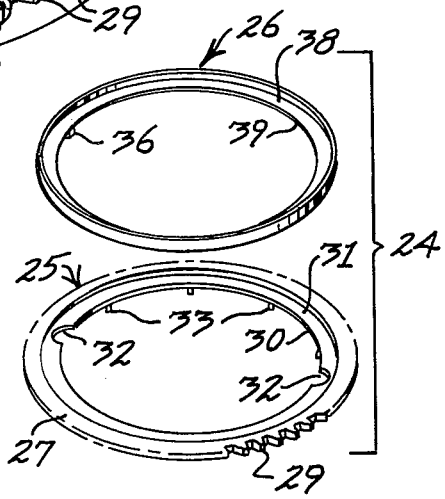
FIG. 5 is an exploded, perspective view of the ring saw apparatus, made in accordance with this invention.
Figure 4:
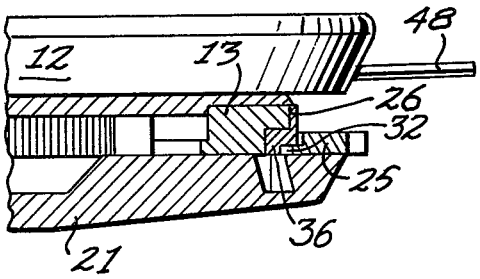
FIG. 4 is another sectional elevation similar to FIG. 3, but taken along the line 4—4 of FIG. 1.

The trimmer apparatus 10 (FIG. 2) includes an annular dial pad 11 having a trim plate 12 and a fixed annular bearing 13. The bearing 13 is provided with an annular cylindrical bearing surface 14 and an upper annular stop flange 15.

Projecting concentrically upward from the top of the trim plate 12 is an annular boss 17 forming a rotary bearing for the vertical drive shaft 18.

A welting dial 21 is secured to the shaft 18, for rotation therewith, by sleeve 20, and held in place by the screw 22. Fitted between the welting dial 21 and the bearing 13 is the ring saw apparatus 24 in accordance with this invention, and adapted to rotate with the welting dial 21.

The shaft 18 is driven in a conventional manner by a motor, not shown, above the knitting head and the trimming apparatus 10.

The ring saw apparatus 24, made in accordance with this invention, includes two separate discrete elements, a rotary ring saw blade 25, and a ring carrier 26.

The saw blade 25 is an annular member having substantially parallel top and bottom continuously flat or planar surfaces or faces 27 and 28. The outer rim of the saw blade 25 forms endless serrations or saw teeth 29 having top and bottom planar teeth surfaces. The inner perimeter 30 of the saw blade 25 has an inner diameter substantially equal to the outer diameter of the bearing surface 14 of the bearing 13, for receiving and slidably engaging the bearing surface 14, for relative rotary movement.

The inner portion of the top face 27 of the saw blade 25 is depressed or recessed to form an annular horizontal planar seat 31. Cut out of diametrically opposed portions of the annular seat 31 and passing through the inner bearing surface 30 are a pair of dog recesses or openings 32. Depending from the bottom face 28 of the saw blade 25 are a plurality of equally, and circumferentially, spaced lugs 33 adapted to engage corresponding interstices formed between the dial walls of the welting dial 21, to grip the welting dial 21 for rotation therewith.

The ring carrier 26 has a bottom planar surface 35 of a radial width substantially equal to the radial width of the seat 31, and adapted to rest upon the seat 31. Thus, the outer diameter of the ring carrier 26 is equal to the outer diameter of the ring seat 31, while the inner diameter of the ring carrier 26 is equal to the inner diameter of the inner bearing surface 30 of the saw blade 25.

Depending from the bottom surfaces 35 of the ring carrier 26 are a pair of diametrically opposed dogs or pawls 36 adapted to register with, and be received in, the corresponding dog openings 32.

Within the top of the ring carrier 26 is formed a recessed horizontal planar bearing surface 38 adapted to slidably engage the bottom horizontal surface of the stop ledge 15. The cyclindrical inner bearing surface or perimeter 39 of the ring carrier 26 is equal in diameter to the inner bearing surface 30 of the saw blade 25, and both inner bearing surfaces 39 and 30 are adapted to slide or rotably bear upon the cylindrical bearing surface 14 of the fixed bearing 13.

The outer surface of the ring carrier 26 is cylindrical and projects upward from the saw blade 25, in assembled position, to form a peripheral rim or flange 40. The outer diameter of the cylindrical flange 40 is substantially less than the diameter of the outer rim of the saw blade 25. The projecting flange 40 provides an inner guide wall for the saw apparatus 24 to prevent a thread 45 carried by one of the saw teeth 29 from slipping radially inward into the area between the saw blade 25 and the dial pad 11 and jamming the operation of the trimming apparatus 10, in the event the knife 43 fails to cut the thread.

Mounted on top of the trim plate 12 adjacent its periphery, is a knife holder 42 supporting the knife 43, biased downward into engagement with the top surface 27 of the saw blade 25, and adjacent the saw teeth 29. The knife 43 and knife holder 42 are of conventional construction. The knife 43 is adapted to cooperate with the saw teeth 29 as they rotate past the knife in order to cut a thread 45. The thread 45 may be fed through a conventional thread guide 47, beneath the guide pins 48, and around an appropriate rotating saw tooth 29, and then back to the hook of the knitting needle 50.

In order to assemble the trimming apparatus 10, the ring carrier 26 is seated in the annular seat 31 of the rotary saw blade 25. The carrier 26 is then rotated until the depending dogs 36 register with, and drop through, their corresponding openings 32. Thus, the ring carrier 26 is locked in position within the saw blade 25, so that both the carrier 26 and the saw blade 25 will move as a unit when rotated. The assembled ring saw apparatus 24 is then mounted concentrically upon the upper face of the welting dial 21 until the lugs 33 have seated between the dial walls of the welting dial 21, so that the welting dial 21 and the ring saw apparatus 24 will also move as a complete unit when rotated. The welting dial 21, carrying the concentrically mounted ring saw apparatus 24 is then fitted into the dial pad 11 until the inner surfaces 30 and 39 of the saw blade 25 and carrier 26, respectively, rotatably engage the bearing surface 14 of the fixed bearing 13 on the dial pad 11.

The screw 22 is then threadedly secured within the rotary shaft 18 to secure the various elements together for rotation of the welting dial 21 and the ring saw apparatus 24 about the fixed bearing 13. Thread or yarn 45 is fed through the thread guide 47, looped about one of the saw teeth 29 and then threaded through the hook of the appropriate knitting needle 50.

When the circular knitting machine is started, a motor, not shown, coupled to the shaft 18 drives the shaft 18 to rotate the welting dial 29 and rotary saw apparatus 24 in the direction of the arrow disclosed in FIG. 1. The saw tooth 29, supporting the thread 45, carries the thread 45 beneath the guide pins 48 until the saw tooth 29 moves beneath the knife 43, at which time the thread is severed.

It will be understood that multiple thread guides 47 are spaced peripherally around the trimming apparatus 10, each thread guide 47 feeding a plurality of threads 45 to different needles 50.

When the saw teeth 29 become worn or dull, the machine is stopped, the screw 22 unthreaded, and the welting dial 21 and rotary saw apparatus 24 are removed from the shaft 18. The carrier is then quickly separated from the saw blade 25 by lifting the carrier 26 upward until the dogs 36 have cleared their corresponding openings 32. The saw blade 25, which is planar on its upper surface 27 and lower surface 28, can then be easily sharpened or ground in a conventional sharpening machine. After the teeth 29 are sharpened, the ring carrier 26 and saw blade 25 are re-assembled, remounted upon the welting dial 21, and the welting dial is assembled upon the shaft 18, as previously described.

The ring carrier 26 and the separate saw blade 25 are more easily constructed or manufactured than the unitary ring saws previously known and used conventionally. Furthermore, by the rapid disassembly of the two discrete parts 25 and 26, the saw teeth 29 may be more easily and more accurately sharpened.

The inner thread guide flange forming an integral part of the conventional unitary ring saw is now formed upon the ring carrier 26 in the form of the annular rim or flange 40. Such flange 40 still performs its same function of preventing the thread from slipping beaneath the dial pad 11 when the parts 26 and 25 are assembled for rotation. Furthermore, when the parts are disassembled, the annular flange 40 no longer forms an obstruction upon the saw blade 25 while the saw blade is being sharpened.

What is claimed is:

1. In a circular knitting machine including a welting dial having dial walls defining interstices therebetween and rotatably mounted upon a dial pad having an annular bearing surface, a knife mounted upon and depending from the periphery of the dial pad, a rotary saw apparatus adapted to be mounted between said dial and said dial pad, comprising:

(a) a discrete ring saw blade having parallel, substantially continuously planar top and bottom surfaces, a circular inner perimeter, and an outer rim forming uniformly circumferentially spaced teeth having radially projecting top and bottom planar teeth surfaces, (b) a plurality of lugs depending from the bottom face of said ring saw blade adapted to detachably seat within interstices berween the dial walls of said welting dial for rotary movement of said ring saw blade with said welting dial in operative position, (c) a discrete ring carrier having a top surface and a bottom planar surface, a cylindrical inner bearing surface, and a cylindrical outer flange projecting upward substantially above the top surface of said ring carrier, the outer diameter of said flange being substantially less than the diameter of said outer rim of said saw blade, (d) the inner diameter of said inner perimeter of said saw blade and said inner bearing surface of said ring carrier being substantially equal to the diameter of the annular bearing surface of said dial pad so that said carrier and said saw blade receive and rotatably engage the bearing surface of said dial pad in said operative position, (e) an annular recess in the top face of said saw blade having an outer diameter substantially equal to the outer diameter of said outer flange, the bottom surface of said ring carrier being adapted to seat concentrically within said annular recess, (f) dog-and-slot means on said carrier and said saw blade for detachably securing said carrier to said saw blade for rotary movement together and permitting axial separation of said saw blade from said carrier to facilitate the sharpening of the teeth of said ring saw blade independently of said carrier, (g) said outer flange projecting upward substantially above the top planar face of said saw blade when said ring carrier is seated in said annular recess, and (h) only said planar top surface of said saw blade, including said top planar teeth surfaces, engaging the knife in said operative position.

* * * * *